US010760563B2

(12) United States Patent
Ishida et al.

(10) Patent No.: US 10,760,563 B2
(45) **Date of Patent: *Sep. 1, 2020**

(54) REFRIGERANT COMPRESSOR AND REFRIGERATION DEVICE INCLUDING REFRIGERANT COMPRESSOR

(71) Applicant: Panasonic Intellectual Property Management Co., Ltd., Osaka-shi, Osaka (JP)

(72) Inventors: Yoshinori Ishida, Kyoto (JP); Shingo Oyagi, Osaka (JP); Hiroyuki Fukuhara, Shiga (JP); Hirotaka Kawabata, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 264 days.

This patent is subject to a terminal disclaimer.

(21) Appl. No.: 15/757,620

(22) PCT Filed: Aug. 26, 2016

(86) PCT No.: PCT/JP2016/003908

§ 371 (c)(1),
(2) Date: Mar. 5, 2018

(87) PCT Pub. No.: WO2017/043035

PCT Pub. Date: Mar. 16, 2017

(65) Prior Publication Data

US 2018/0245576 A1 Aug. 30, 2018

(30) Foreign Application Priority Data

Sep. 7, 2015 (JP) ..... 2015-175283

(51) Int. Cl.
*F04B 39/02* (2006.01)
*F25B 31/00* (2006.01)

(52) U.S. Cl.
CPC ..... *F04B 39/023* (2013.01); *F25B 31/002* (2013.01); *F04B 39/0215* (2013.01);
(Continued)

(58) Field of Classification Search
CPC .... F04B 39/00; F04B 39/023; F04B 39/0215; F05C 2203/06; F05C 2203/08;
(Continued)

(56) References Cited

U.S. PATENT DOCUMENTS 3,698,204 A * 10/1972 Schlotterbeck ..... B60H 1/321 62/206
5,531,574 A 7/1996 Honma
(Continued)

FOREIGN PATENT DOCUMENTS

CN 1186872 A 7/1998
CN 101395377 A 3/2009
(Continued)

OTHER PUBLICATIONS

Office Action issued for Chinese Patent Application No. 201680051857.3, dated Nov. 21, 2018, 12 pages including English translation.
(Continued)

*Primary Examiner* — Charles G Freay
(74) *Attorney, Agent, or Firm* — Hamre, Schumann, Mueller & Larson, P.C.

(57) ABSTRACT

A refrigerant compressor reserves lubricating oil with a viscosity of VG2 to VG100 in a sealed container, and accommodates therein an electric component and a compression component which is driven by the electric component and compresses a refrigerant. The compression component includes at least one slide member comprising a base material 171 made of an iron-based material and an oxide coating film 170 provided on a surface of the base material 171. The oxide coating film 170 includes: a portion con-
(Continued)

taining diiron trioxide ($Fe_2O_3$), in a region which is closer to an outermost surface of the oxide coating film; and a silicon containing portion containing silicon (Si) which is more in quantity than silicon (Si) of the base material 171, in a region which is closer to the base material 171.

14 Claims, 7 Drawing Sheets

(52) U.S. Cl.
CPC ..... *F05C 2203/06* (2013.01); *F05C 2203/08* (2013.01); *F05C 2253/12* (2013.01)

(58) Field of Classification Search
CPC .... F05C 2253/12; F25B 31/002; F16C 33/12; F16C 2360/42; C23C 8/10
See application file for complete search history.

(56) References Cited

U.S. PATENT DOCUMENTS

| | | | |
|---|---|---|---|
| 2003/0201864 | A1 | 10/2003 | Decristofaro et al. |
| 2007/0266808 | A1 | 11/2007 | Kanemitsu et al. |
| 2010/0061871 | A1 | 3/2010 | Arai et al. |
| 2012/0285584 | A1 | 11/2012 | Wang et al. |
| 2016/0017874 | A1 | 1/2016 | Ishida et al. |

FOREIGN PATENT DOCUMENTS

| | | | |
|---|---|---|---|
| CN | 102628154 | A | 8/2012 |
| CN | 102661263 | A | 9/2012 |
| CN | 102661264 | A | 9/2012 |
| EP | 1489261 | A1 | 12/2004 |
| EP | 2 113 580 | A1 * | 3/2009 |
| EP | 2818716 | A1 | 12/2014 |
| JP | H07238885 | A | 9/1995 |
| JP | H11141461 | A | 5/1999 |
| JP | 2005030376 | A | 2/2005 |
| JP | 2011-139075 | | 7/2011 |
| JP | 2013-513724 | | 4/2013 |
| WO | 2006051656 | A1 | 5/2006 |
| WO | 2008143589 | A1 | 11/2008 |
| WO | 2013125197 | A1 | 8/2013 |

OTHER PUBLICATIONS

International Search Report issued for International Patent Application No. PCT/JP2016/003908, dated Nov. 29, 2016, 5 pages including English translation.

Extended European Search Report issued for European Patent Application No. 16843905.7, dated Jun. 6, 2018, 7 pages.

Fukumoto, et al., "The effect of Si Concentration and Temperature on Initial Stage of High Temperature Oxidation of Fe-low Si Alloys", Tetsu-to-Hagane, vol. 85 (1999), No. 12, pp. 16-22, includes an English Synopsis.

Fukumoto, et al., "The effect of Temperature and Water Vapor on the Initial Stage of High Temperature Oxidation of an Fe-1.5mass%Si Alloy", Tetsu-to-Hagane, vol. 86 (2000), No. 8, pp. 28-35, includes an English Synopsis.

Yanagihara, et al., "Characterization of Oxidation Behavior on an Fe—Si Alloy Surface", Shinnittetsu Giho (Nippon Steel Technical Report), vol. 390 (2010), pp. 28-34, includes and English Abstract.

Nakamura, et al. "Effects of O2 and H2O Content in Heating Atmosphere on Scale Properties of Steel Plate at High Temperature", Tetsu-to-Hagane, vol. 79 (1993), No. 6, pp. 74-80, includes an English Synopsis.

Takeda, et al., "Influence of Silicon Content on the Structure and Adhesion of Primary Scales on Si Containing Steels", R & D Kobe Steel engineering reports, vol. 55 (2005), No. 1, pp. 31-36, includes an English Abstract.

* cited by examiner

Base material side ← → Outermost surface side

REFRIGERANT COMPRESSOR AND REFRIGERATION DEVICE INCLUDING REFRIGERANT COMPRESSOR

TECHNICAL FIELD

The present invention relates to a refrigerant compressor for use with a refrigerator, an air conditioner, or the like, and a refrigeration device including the refrigerant compressor.

BACKGROUND ART

In recent years, for the purpose of global environment conservation, a refrigerant compressor with a higher efficiency, which can reduce the use of fossil fuel, has been developed.

One approach for achievement of the higher efficiency of the refrigerant compressor is, for example, formation of a phosphate coating film on a slide surface of a slide section such as a piston or a crankshaft to prevent abrasion of the slide section. By forming this phosphate coating film, unevenness of the processed surface of a machine processing finish can be removed, and initial conformability between slide members can be improved (e.g., see Patent Literature 1).

FIG. 8 is a cross-sectional view of a conventional refrigerant compressor disclosed in Patent Literature 1. As shown in FIG. 8, a sealed container 1 is an outer casing of the refrigerant compressor. Lubricating oil 2 is reserved in the bottom portion of the sealed container 1. The sealed container 1 accommodates therein an electric component 5 including a stator 3 and a rotor 4, and a reciprocating compression component 6 driven by the electric component 5.

The compression component 6 includes a crankshaft 7, a cylinder block 11, a piston 15, and the like. The configuration of the compression component 6 will be described below.

The crankshaft 7 includes at least a main shaft section 8 to which the rotor 4 is pressingly secured, and an eccentric shaft 9 which is provided eccentrically with the main shaft section 8. The crankshaft 7 is provided with an oil feeding pump 10.

The cylinder block 11 forms a compression chamber 13 including a bore 12 with a substantially cylindrical shape and includes a bearing section 14 supporting the main shaft section 8.

The piston 15 is loosely fitted into the bore 12 with a clearance. The piston 15 is coupled to the eccentric shaft 9 via a connecting rod 17 as a coupling means by use of a piston pin 16. The end surface of the bore 12 is closed by a valve plate 18.

A head 19 is secured to the valve plate 18 on a side opposite to the bore 12. The head 19 constitute a high-pressure chamber. A suction tube 20 is secured to the sealed container 1 and connected to a low-pressure side (not shown) of a refrigeration cycle. The suction tube 20 leads a refrigerant gas (not shown) to the inside of the sealed container 1. A suction muffler 21 is retained between the valve plate 18 and the head 19.

The main shaft section 8 of the crankshaft 7 and the bearing section 14, the piston 15 and the bore 12, the piston pin 16 and the connecting rod 17, the eccentric shaft 9 of the crankshaft 7 and the connecting rod 17 constitute slide sections.

In a combination of the iron-based materials among the slide members constituting the slide sections, as described above, an insoluble phosphate coating film comprising a porous crystalline body is provided on the slide surface of one of the iron-based materials.

Next, the operation of the sealed compressor having the above-described configuration will be described. Electric power is supplied from a power supply utility (not shown) to the electric component 5, to rotate the rotor 4 of the electric component 5. The rotor 4 rotates the crankshaft 7. By an eccentric motion of the eccentric shaft 9, the piston 15 is driven via the connecting rod 17 as a coupling means and the piston pin 16. The piston 15 reciprocates inside the bore 12. By the reciprocating motion of the piston 15, a refrigerant gas is led to the inside of the sealed container 1 through the suction tube 20, suctioned from the suction muffler 21 into the compression chamber 13, and compressed inside the compression chamber 13 in succession.

According to the rotation of the crankshaft 7, the lubricating oil 2 is fed to the slide sections by the oil feeding pump 10, and lubricates each of the slide sections. In addition, the lubricating oil 2 serves to seal a gap formed between the piston 15 and the bore 12.

The main shaft section 8 of the crankshaft 7 and the bearing section 14 perform a rotation. While the refrigerant compressor is stopped, a rotational speed is 0 m/s. During start-up of the refrigerant compressor, the rotation starts in a state in which the metals are in contact with each other, and a great frictional resistance force is generated. In this refrigerant compressor, the phosphate coating film is provided on the main shaft section 8 of the crankshaft 7, and has an initial conformability. In this structure, the phosphate coating film can prevent an abnormal abrasion caused by the contact between the metals during start-up of the refrigerant compressor.

CITATION LIST

Patent Literature

Patent Literature 1: Japanese-Laid Open Patent Application Publication No. Hei. 7-238885

SUMMARY OF INVENTION

Technical Problem

In recent years, to provide higher efficiency of the refrigerant compressor, the lubricating oil 2 with a lower viscosity is used, or a slide length of the slide sections (a distance for which the slide sections slide) is designed to be shorter. For this reason, the conventional phosphate coating film is likely to be abraded or worn out at earlier time and it may be difficult to maintain the conformability between the slide surfaces. As a result, the abrasion resistance of the phosphate coating film may be degraded.

In the refrigerant compressor, while the crankshaft 7 is rotating once, a load applied to the main shaft section 8 of the crankshaft 7 is significantly changed. With this change in the load, the refrigerant gas dissolved into the lubricating oil 2 is evaporated into bubbles, in a region between the crankshaft 7 and the bearing section 14. The bubbles cause an oil film to run out, and the contact between the metals occurs more frequently.

As a result, the phosphate coating film provided on the main shaft section 8 of the crankshaft 7 is likely to be abraded at earlier time and a friction coefficient is likely to be increased. With the increase in the friction coefficient, the slide section generates more heat, and thereby abnormal abrasion such as adhesion may occur. A similar phenomenon may occur in the region between the piston 15 and the bore 12. Therefore, the piston 15 and the bore 12 have the same problem as that occurring in the crankshaft 7.

The present invention has been developed to solve the above described problem associated with the prior art, and an object of the present invention is to provide a refrigerant compressor which can improve an abrasion resistance of a slide member, to realize high reliability and high efficiency, and a refrigeration device including the refrigerant compressor.

Solution to Problem

To achieve the above-described object, according to the present invention, there is provided a refrigerant compressor which reserves lubricating oil with a viscosity of VG2 to VG100 in a sealed container, and accommodates therein an electric component and a compression component which is driven by the electric component and compresses a refrigerant, the compression component including at least one slide member comprising a base material made of an iron-based material and an oxide coating film provided on a surface of the base material, and the oxide coating film including: a portion containing diiron trioxide ($Fe_2O_3$), in a region which is closer to an outermost surface of the oxide coating film; and a silicon containing portion containing silicon (Si) which is more in quantity than silicon (Si) of the base material, in a region which is closer to the base material.

In accordance with this configuration, the silicon containing portion can improve adhesivity of the oxide coating film to the base material, and the portion containing diiron trioxide ($Fe_2O_3$) can effectively suppress the attacking characteristic with respect to the other member (sliding between the slide member including the oxide coating film and the other member occurs), and improve conformability of the slide surface of the slide member to the slide surface of the other member. This makes it possible to improve the abrasion resistance of the slide member. Therefore, the viscosity of the lubricating oil can be reduced, and the slide length of each of the slide members constituting the slide sections can be designed to be shorter. Since a sliding loss of the slide sections can be reduced, reliability, efficiency, and performance of the refrigerant compressor can be improved.

To achieve the above-described object, a refrigerant compressor of the present invention comprises a refrigerant circuit including the refrigerant compressor having the above-described configuration, a heat radiator, a pressure reducing unit, and a heat absorber, which are annularly coupled to each other via a pipe.

In accordance with this configuration, the refrigeration device includes the refrigerant compressor with higher compressor efficiency. Therefore, electric power consumption of the refrigeration device can be reduced, and energy (power) saving can be realized.

The above and further objects, features and advantages of the present invention will more fully be apparent from the following detailed description of preferred embodiments with reference to accompanying drawings.

Advantageous Effects of Invention

The present invention has advantages in that with the above-described configuration, it becomes possible to provide a refrigerant compressor which can improve an abrasion resistance of a slide member, to realize high reliability and high efficiency, and a refrigeration device including the refrigerant compressor.

DESCRIPTION OF EMBODIMENTS

Figure 1:
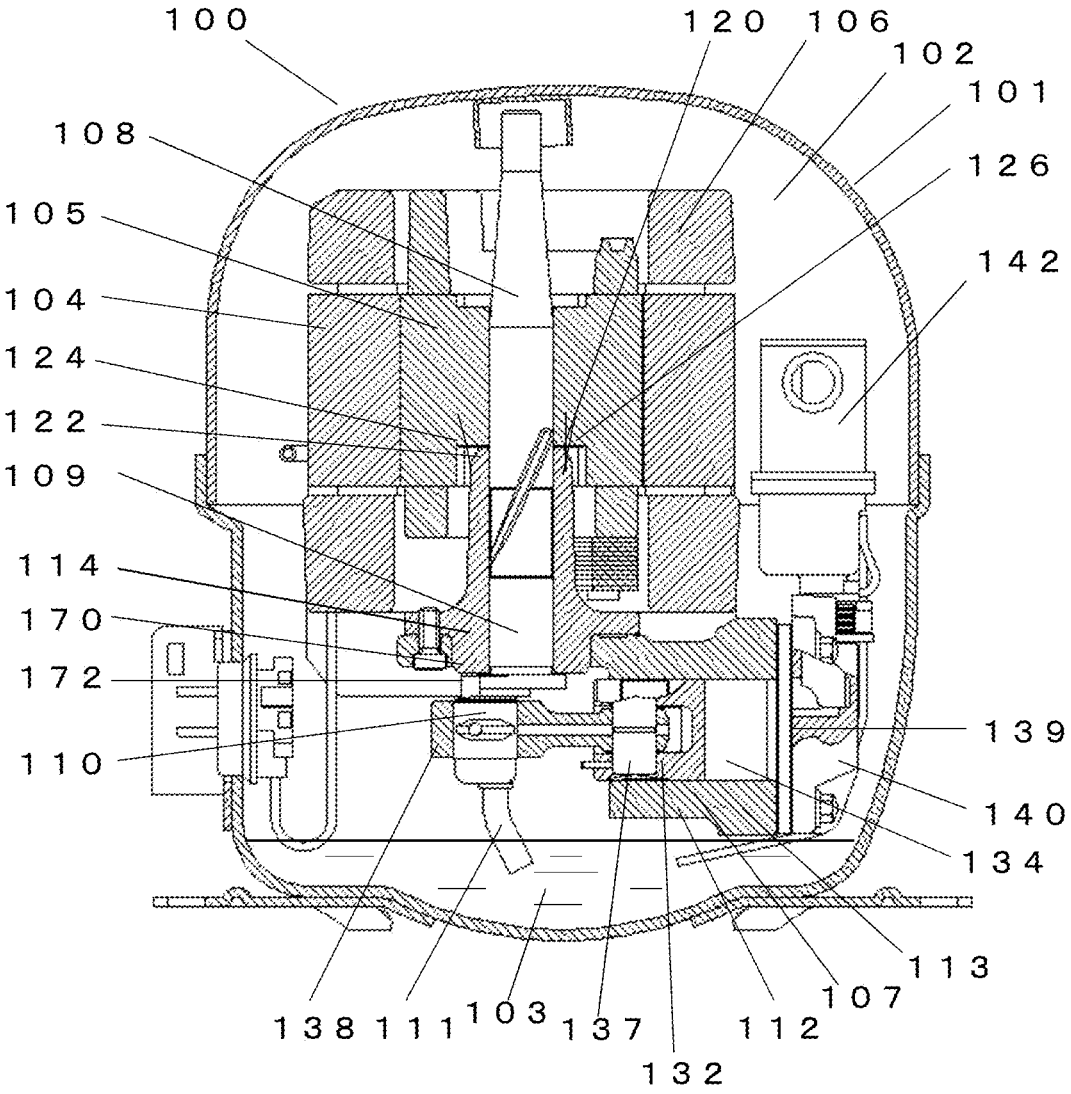
FIG. 1 is a schematic cross-sectional view of a refrigerant compressor according to Embodiment 1 of the present disclosure.

According to the present disclosure, there is provided a refrigerant compressor which reserves lubricating oil with a viscosity of VG2 to VG100 in a sealed container, and accommodates therein an electric component and a compression component which is driven by the electric component and compresses a refrigerant, the compression component including at least one slide member comprising a base material made of an iron-based material and an oxide coating film provided on a surface of the base material, and the oxide coating film including: a portion containing diiron trioxide ($Fe_2O_3$), in a region which is closer to an outermost surface of the oxide coating film; and a silicon containing portion containing silicon (Si) which is more in quantity than silicon (Si) of the base material, in a region which is closer to the base material.

In accordance with this configuration, the silicon containing portion can improve adhesivity of the oxide coating film to the base material, and the portion containing diiron trioxide ($Fe_2O_3$) can effectively suppress the attacking characteristic with respect to the other member (sliding between the slide member including the oxide coating film and the other member occurs), and improve conformability of the slide surface of the slide member to the slide surface of the other member. This makes it possible to improve the abrasion resistance of the slide member. Therefore, the viscosity of the lubricating oil can be reduced, and the slide length of each of the slide members constituting the slide sections can be designed to be shorter. Since a sliding loss of the slide sections can be reduced, reliability, efficiency, and performance of the refrigerant compressor can be improved.

In the refrigerant compressor having the above-described configuration, the oxide coating film may include a spot-shaped silicon containing portion which is located closer to the outermost surface of the oxide coating film than the silicon containing portion, the spot-shaped silicon containing portion being a portion containing silicon (Si) which is more in quantity than silicon (Si) contained in a region surrounding the spot-shaped silicon containing portion.

In this configuration, the silicon containing portion located in the region which is closer to the base material can improve the adhesivity of the oxide coating film to the base material. In addition, since the spot-shaped silicon containing portions are located in the region of the oxide coating film which is closer to the outermost surface of the oxide coating film, a number of silicon (Si) compounds which are relatively hard are present in the region which is closer to the outermost surface of the oxide coating film. This makes it possible to improve the abrasion resistance of the oxide coating film. Since a sliding loss of the slide sections can be reduced, reliability and performance of the refrigerant compressor can be improved.

In the refrigerant compressor having the above-described configuration, the oxide coating film may include at least: a portion containing diiron trioxide ($Fe_2O_3$) which is more in quantity than other substances; and a portion containing triiron tetraoxide ($Fe_3O_4$) which is more in quantity than other substances, the portion containing diiron trioxide ($Fe_2O_3$) and the portion containing triiron tetraoxide ($Fe_3O_4$) being arranged in this order from the outermost surface.

In this configuration, since diiron trioxide ($Fe_2O_3$) which is located in the region which is closer to the outermost surface of the oxide coating film suppresses the attacking characteristic of the slide member to the other member and improve the conformability of the slide surface of the slide member to the slide surface of the other member, reliability of the refrigerant compressor can be improved.

In the refrigerant compressor having the above-described configuration, the oxide coating film may include at least: a portion containing diiron trioxide ($Fe_2O_3$) which is more in quantity than other substances; a portion containing triiron tetraoxide ($Fe_3O_4$) which is more in quantity than other substances; and a portion containing iron oxide (FeO) which is more in quantity than other substances, the portion containing diiron trioxide ($Fe_2O_3$), the portion containing triiron tetraoxide ($Fe_3O_4$), and the portion containing iron oxide (FeO) being arranged in this order from the outermost surface.

In this configuration, diiron trioxide ($Fe_2O_3$) which is located in the region which is closer to the outermost surface of the oxide coating film suppresses the attacking characteristic of the slide member with respect to the other member and improve the conformability of the slide surface of the slide member to the slide surface of the other member. In addition, iron oxide (FeO) located in the region which is closer to the base material can effectively lessen the presence of the weak structure such as crystal grain boundary or lattice defects. This makes it possible to increase a bearing force of the oxide coating film with respect to a load while the slide member is sliding. Therefore, the peeling of the oxide coating film can be suppressed, and the adhesive force of the oxide coating film to the base material can be improved. As a result, reliability of the refrigerant compressor can be improved.

In the refrigerant compressor having the above-described configuration, the oxide coating film may have a thickness in a range of 1 to 5 μm.

In this configuration, since the abrasion resistance of the oxide coating film can be increased, long-time reliability of the oxide coating film can be improved. In addition, since dimension accuracy of the oxide coating film can be stabilized, productivity of the slide member can be increased.

In the refrigerant compressor having the above-described configuration, the iron-based material may contain 0.5 to 10% silicon.

In this configuration, since the adhesivity of the oxide coating film to the iron-based material (base material) can be further improved, the bearing force of the oxide coating film can be further increased. As a result, reliability of the refrigerant compressor can be further improved.

In the refrigerant compressor having the above-described configuration, the iron-based material may be cast iron.

Since cast iron is inexpensive and has a high productivity, cost of the slide member can be reduced. Since the adhesivity of oxide coating film to the iron-based material (base material) can be further improved, the bearing force of the oxide coating film can be further increased. As a result, reliability of the refrigerant compressor can be further improved.

In the refrigerant compressor having the above-described configuration, the refrigerant may be a HFC-based refrigerant such as R134a, or a mixed refrigerant of the HFC-based refrigerant, and the lubricating oil may be one of ester oil, alkylbenzene oil, polyvinyl ether, and polyalkylene glycol, or mixed oil including any of ester oil, alkylbenzene oil, polyvinyl ether, and polyalkylene glycol.

Even in a case where the lubricating oil with a low viscosity is used, an abnormal abrasion of the slide member can be prevented. In addition, a sliding loss of the slide member can be reduced. Therefore, reliability and efficiency of the refrigerant compressor can be improved.

In the refrigerant compressor having the above-described configuration, the refrigerant may be a natural refrigerant such as R600a, R290, or R744, or a mixed refrigerant including any of the natural refrigerants, and the lubricating oil may be one of mineral oil, ester oil, alkylbenzene oil, polyvinyl ether, and polyalkylene glycol, or mixed oil including any of mineral oil, ester oil, alkylbenzene oil, polyvinyl ether, and polyalkylene glycol.

Even in a case where the lubricating oil with a low viscosity is used, an abnormal abrasion of the slide member can be prevented. In addition, a sliding loss of the slide member can be reduced. Therefore, reliability and efficiency of the refrigerant compressor can be improved. Further, by use of the refrigerant which produces less greenhouse effect, global warming can be suppressed.

In the refrigerant compressor having the above-described configuration, the refrigerant may be a HFO-based refrigerant such as R1234yf, or a mixed refrigerant of the HFO-based refrigerant, and the lubricating oil may be one of ester oil, alkylbenzene oil, polyvinyl ether, and polyalkylene glycol, or mixed oil including ester oil, alkylbenzene oil, polyvinyl ether, and polyalkylene glycol.

Even in a case where the lubricating oil with a low viscosity is used, an abnormal abrasion of the slide member can be prevented. In addition, a sliding loss of the slide member can be reduced. Therefore, reliability and efficiency of the refrigerant compressor can be improved. Further, by use of the refrigerant which produces less greenhouse effect, global warming can be suppressed.

In the refrigerant compressor having the above-described configuration, the electric component may be inverter-driven at one of a plurality of operating frequencies.

During a low-speed operation (running) in which oil is not sufficiently fed to the slide sections, the oxide coating film with a high abrasion resistance can improve reliability. Also, during a high-speed operation (running) in which the rotational speed of the electric component increases, the oxide coating film with a high abrasion resistance can maintain high reliability. As a result, reliability of the refrigerant compressor can be further improved.

A refrigeration device according to the present disclosure comprises a refrigerant circuit including the refrigerant compressor having the above-described configuration, a heat radiator, a pressure reducing unit, and a heat absorber, which are annularly coupled to each other via a pipe.

In accordance with this configuration, the refrigeration device includes the refrigerant compressor with higher compressor efficiency. Therefore, electric power consumption of the refrigeration device can be reduced, and energy (power) saving can be realized. Further, reliability of the refrigeration device can be improved.

Now, typical embodiments of the present disclosure will be described with reference to the drawings. Throughout the drawings, the same or corresponding components (members) are designated by the same reference symbols, and will not be described in repetition.

Embodiment 1

[Configuration of Refrigerant Compressor]

Figure 2A:
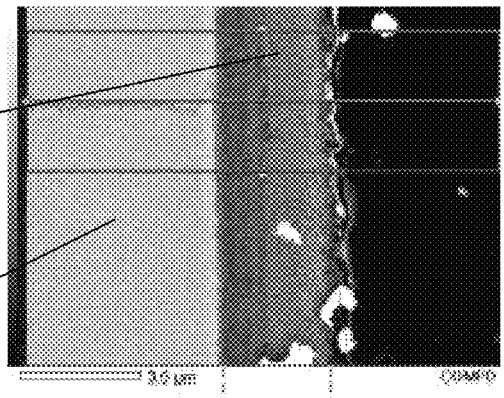
FIG. 2A is a SEM (scanning electron microscope) image showing an example of a result of SEM observation performed for an oxide coating film provided on a slide member of the refrigerant compressor according to Embodiment 1.

Firstly, a typical example of the refrigerant compressor according to Embodiment 1 will be specifically described with reference to FIGS. 1 and 2A. FIG. 1 is a cross-sectional view of a refrigerant compressor 100 according to Embodiment 1. FIG. 2A is a SEM (scanning electron microscope) image showing an example of a result of SEM observation performed for a slide section of the refrigerant compressor 100.

As shown in FIG. 1, in the refrigerant compressor 100, a refrigerant gas 102 comprising R134a is filled inside a sealed container 101, and ester oil as lubricating oil 103 is reserved in the bottom portion of the sealed container 101. Inside the sealed container 101, an electric component 106 including a stator 104 and a rotor 105, and a reciprocating compression component 107 configured to be driven by the electric component 106 are accommodated.

The compression component 107 includes a crankshaft 108, a cylinder block 112, a piston 132, and the like. The compression component 107 will be described below.

The crankshaft 108 includes at least a main shaft section 109 to which the rotor 105 is pressingly secured, and an eccentric shaft 110 which is provided eccentrically with the main shaft section 109. An oil feeding pump 111 is provided at the lower end of the crankshaft 108 and is in communication with the lubricating oil 103.

The crankshaft 108 comprises a base material 171 made of gray cast iron (FC cast iron) containing about 2% silicon (Si), and an oxide coating film 170 provided on a surface of the base material 171. FIG. 2A shows a typical example of the oxide coating film 170 according to Embodiment 1. FIG. 2A shows an example of a result of SEM (scanning electron microscope) observation performed for the cross-section of the oxide coating film 170 and shows the image of whole of the oxide coating film 170 in a thickness direction.

The oxide coating film 170 according to Embodiment 1 has a thickness of about 3 μm. The oxide coating film 170 of FIG. 2A is formed on a disc (base material 171) used in a ring on disc abrasion test in Example 1 which will be described later.

The cylinder block 112 comprises cast iron. The cylinder block 112 is formed with a bore 113 with a substantially cylindrical shape, and includes a bearing section 114 supporting the main shaft section 109.

The rotor 105 is provided with a flange surface 120. The upper end surface of the bearing section 114 is a thrust surface 122. A thrust washer 124 is disposed between the flange surface 120 and the thrust surface 122 of the bearing section 114. The flange surface 120, the thrust surface 122, and the thrust washer 124 constitute a thrust bearing 126.

The piston 132 is loosely fitted into the bore 113 with a clearance. The piston 132 comprises an iron-based material. The piston 132 forms a compression chamber 134 together with the bore 113. The piston 132 is coupled to the eccentric shaft 110 via a connecting rod 138 as a coupling means by use of a piston pin 137. The end surface of the bore 113 is closed by a valve plate 139.

A head 140 constitutes a high-pressure chamber. The head 140 is secured to the valve plate 139 on a side opposite to the bore 113. A suction tube (not shown) is secured to the sealed container 101 and connected to a low-pressure side (not shown) of a refrigeration cycle. The suction tube leads the refrigerant gas 102 to the inside of the sealed container 101. A suction muffler 142 is retained between the valve plate 139 and the head 140.

The operation of the refrigerant compressor 100 configured as described above will be described below.

Electric power supplied from a power supply utility (not shown) is supplied to the electric component 106, and rotates the rotor 105 of the electric component 106. The rotor 105 rotates the crankshaft 108. An eccentric motion of the eccentric shaft 110 is transmitted to the piston 132 via the connecting rod 138 as the coupling means and the piston pin 137, and drives the piston 132. The piston 132 reciprocates inside the bore 113. The refrigerant gas 102 led to the inside of the sealed container 101 through the suction tube (not shown) is suctioned from the suction muffler 142, and is compressed inside the compression chamber 134.

According to the rotation of the crankshaft 108, the lubricating oil 103 is fed to slide sections by the oil feeding pump 111. The lubricating oil 103 lubricates the slide sections and seals the clearance between the piston 132 and the bore 113. The slide sections are defined as sections (portions) which slide in a state in which a plurality of slide members are in contact with each other in their slide surfaces.

In recent years, to provide higher efficiency of the refrigerant compressor 100, for example, (1) lubricating oil with a lower viscosity is used as the lubricating oil 103 as described above, or (2) the slide length of the slide members (a distance for which the slide members slide) constituting the slide sections is designed to be shorter. For this reason, slide conditions are getting more harsh. Specifically, there is a tendency that the oil film formed between the slide sections is thinner, or difficult to form.

In addition to the above, in the refrigerant compressor 100, the eccentric shaft 110 of the crankshaft 108 is provided eccentrically with the bearing section 114 of the cylinder block 112, and the main shaft section 109 of the crankshaft 108. In this layout, a fluctuating (variable) load which causes a load fluctuation (change) is applied to regions between the main shaft section 109 of the crankshaft 108, the eccentric shaft 110 and the connecting rod 138, due to a gas pressure of the compressed refrigerant gas 102. With the load fluctuation (change), the refrigerant gas 102 dissolved into the lubricating oil 103 is evaporated into bubbles in repetition, in, for example, the region between the main shaft section 109 and the bearing section 114. In this way, the bubbles are generated in the lubricating oil 103.

For the above-described reasons, for example, in the slide sections of the main shaft section 109 of the crankshaft 108 and the bearing section 114, the oil film has run out, and the metals of the slide surfaces contact each other more frequently.

However, the slide section of the refrigerant compressor 100, for example, the slide section of the crankshaft 108 as an example of Embodiment 1 comprises the oxide coating film 170 having the above-described configuration. For this reason, even if the oil film has run out more frequently, the abrasion of the slide surface caused by this can be suppressed over a long period of time.

[Configuration of Oxide Coating Film]

Next, the oxide coating film 170 which can suppress the abrasion of the slide section will be described in more detail with reference to FIGS. 2B to 2D as well as FIG. 2A.

Figure 2B:
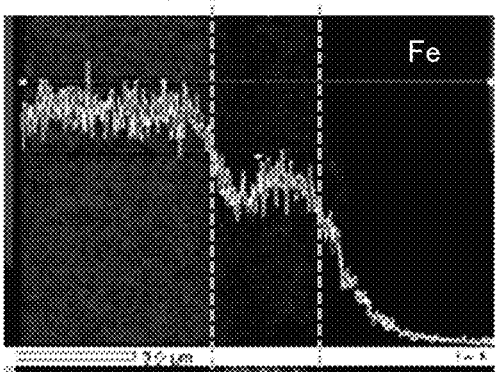
FIGS. 2B to 2D are element maps showing examples of results of EDS analysis performed for the oxide coating film of FIG. 2A.
Figure 2C:
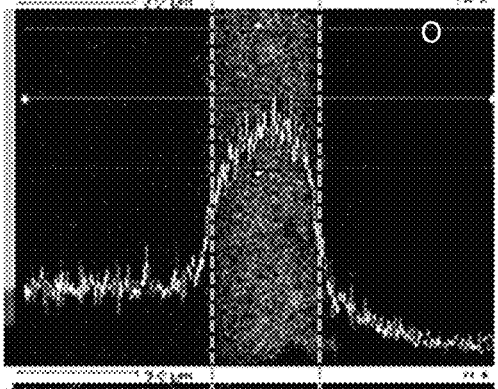
Figure 2D:
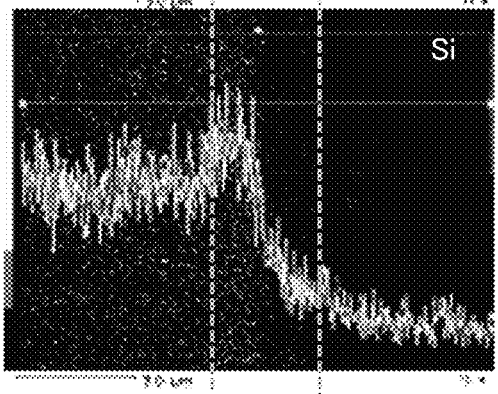

FIGS. 2B to 2D are element maps showing an example of a result of EDS (energy dispersive X-ray spectrometry) analysis performed for the cross-section of the oxide coating film 170 of FIG. 2A. FIG. 2B shows the result of element mapping of iron (Fe) of the oxide coating film 170. FIG. 2C shows the result of element mapping of oxygen (O) of the oxide coating film 170. FIG. 2D shows the result of element mapping of silicon (Si) of the oxide coating film 170.

In Embodiment 1, the crankshaft 108 comprises the base material 171 made of spherical graphite cast iron (FCD cast iron). The oxide coating film 170 is formed on the surface of the base material 171. Specifically, for example, the slide surface of the base material 171 is subjected to polishing finish, and then the oxide coating film 170 is formed by oxidation by use of an oxidation gas.

As described above, as shown in FIG. 2A, in Embodiment 1, the oxide coating film 170 is formed on the base material 171 (on the right side of the base material 171 of FIG. 2A) made of spherical graphite cast iron (FCD cast iron).

Next, the concentration of the elements contained in the oxide coating film 170 (namely, element composition of portions of the oxide coating film 170) will be described with reference to FIGS. 2B to 2D. FIG. 2B shows the result of element mapping of iron (Fe) of the oxide coating film 170. FIG. 2C shows the result of element mapping of oxygen (O) of the oxide coating film 170. FIG. 2D shows the result of element mapping of silicon (Si) of the oxide coating film 170.

FIGS. 2B to 2D show that more elements are present as dots (minute points) are more with respect to a black background. Lines shown in FIGS. 2B to 2D indicate intensity ratios of the elements. In the examples of FIGS. 2B to 2D, the intensity ratios of the elements, namely, the ratios of the elements are higher in an upward direction.

From the results of the element analysis, it can be found out that the concentration ratios of the elements which are iron (Fe), oxygen (O), and silicon (Si) contained in the oxide coating film 170 have a trend as described below.

The spherical graphite cast iron (FCD cast iron) contains silicon (Si) in addition to (Fe). Therefore, in Embodiment 1, the base material 171 comprises substantially two kinds of elements which are iron (Fe) and silicon (Si). The intensity ratios of the elements of the oxide coating film 170 with respect to the base material 171 as the reference will be described.

As shown in FIG. 2B, the intensity ratio of iron (Fe) of the oxide coating film 170 is lower than that of the base material 171, and slightly increases in the inside of the oxide coating film 170. As shown in FIG. 2C, the intensity ratio of oxygen (O) is notably high in the inner side of the oxide coating film 170.

As shown in FIG. 2D, the intensity ratio of silicon (Si) is higher in a portion of the oxide coating film 170 which is closer to the base material 171 than in the base material 171. The intensity ratio of silicon (Si) is significantly reduced in the inner side of the oxide coating film 170 and is almost undetectable in a portion closer to the outermost surface.

Figure 3:
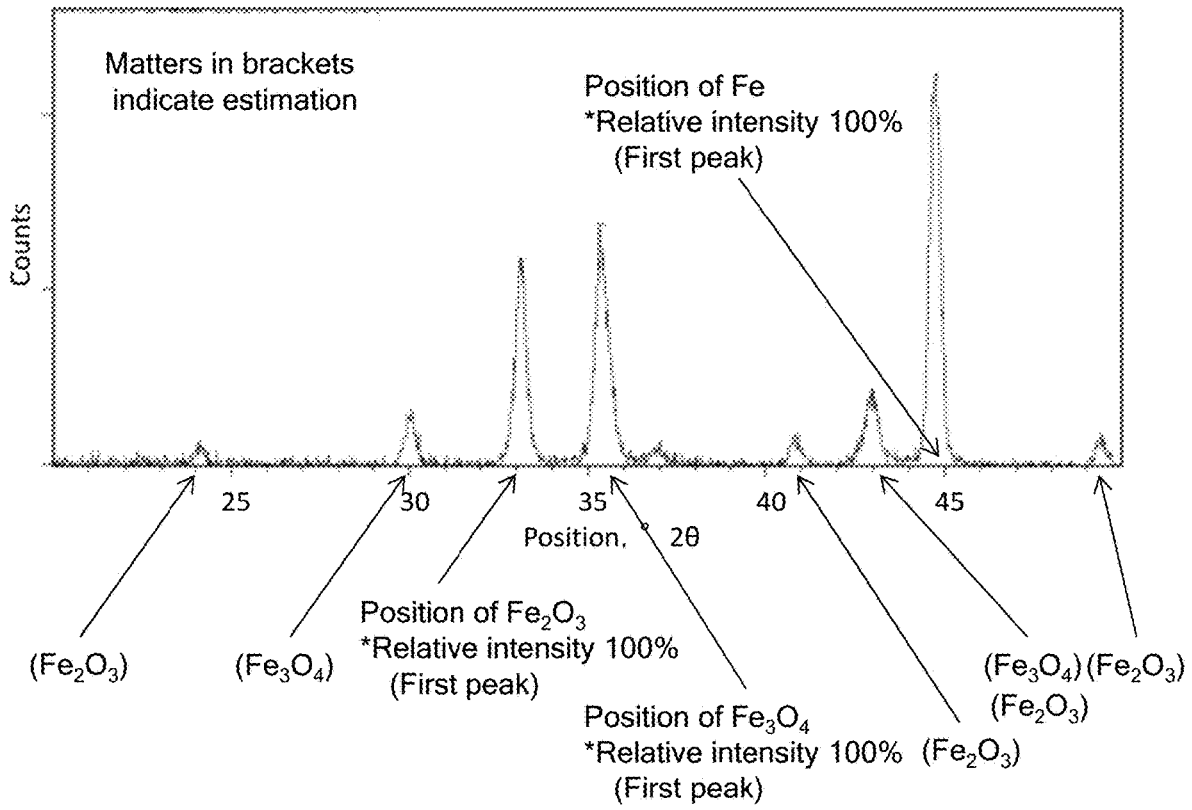
FIG. 3 is a graph showing an example of a result of X-ray diffraction analysis performed for the oxide coating film according to Embodiment 1.

FIG. 3 shows an example of a result of X-ray diffraction analysis performed for the cross-section of the oxide coating film 170 of FIGS. 2A to 2D.

As shown in FIG. 3, in the oxide coating film 170, a peak attributed to the crystals of diiron trioxide ($Fe_2O_3$) or triiron tetraoxide ($Fe_3O_4$) is clearly detected. However, the position of a peak attributed to crystals of an oxide product containing Si and Fe, for example, fayalite ($Fe_2SiO_4$) overlaps with that of diiron trioxide ($Fe_2O_3$) or triiron tetraoxide ($Fe_3O_4$), and is difficult to clearly determine. Further, a peak attributed to FeO is very weak and is difficult to clearly determine.

In Embodiment 1, as described above, the oxide coating film 170 is formed on the surface of the base material 171 by oxidation reaction S oxidation treatment by use of the oxidation gas. In an initial (earlier) stage of the oxidation reaction, for example, the oxide of Fe and Si such as fayalite ($Fe_2SiO_4$) is formed in a region that is in the vicinity of an interface and closer to the base material 171. It is considered that this oxide performs an iron diffusion barrier function, and iron-deficiency state is formed on the surface of the base material 171 as the oxidation reaction progresses. It is estimated that inward diffusion of oxygen is facilitated with the progress of the oxidation reaction.

As a result of this, oxidation of iron oxide (FeO) formed in the initial stage of the oxidation reaction is accelerated. In this way, a crystal structure which contributes to the abrasion resistance, such as diiron trioxide ($Fe_2O_3$) and/or triiron tetraoxide ($Fe_3O_4$), is formed in the oxide coating film 170.

It is estimated that by the accelerated oxidation of iron oxide (FeO), the peak attributed to the crystals of FeO was very weak (namely, FeO was not substantially detected) in the X-ray diffraction analysis performed for the oxide coating film 170 of FIG. 3. This estimation is supported by the result of the element mapping of silicon (Si) of FIG. 2D. Or, in another point of view, iron oxide (FeO) of the oxide coating film 170 may have an amorphous having no crystal structure.

The oxide coating film 170 according to Embodiment 1, may include at least a portion (this portion will be referred to as "III portion" based on the name of diiron trioxide ($Fe_2O_3$), namely, "iron oxide (III)") containing diiron trioxide ($Fe_2O_3$) which is more in quantity than other substances, and a portion (this portion will be referred to as "II, III portion" based on the name of triiron tetraoxide ($Fe_3O_4$), namely, "iron oxide (III), iron (II)") containing triiron tetraoxide ($Fe_3O_4$) which is more in quantity than other substances, the III portion and the II, III portion being disposed in this order from the outermost surface (slide surface) (coating film configuration 1).

Or, the oxide coating film 170 according to Embodiment 1, may include at least the III portion containing diiron trioxide ($Fe_2O_3$) which is more in quantity than other substances, the II, III portion containing triiron tetraoxide ($Fe_3O_4$) which is more in quantity than other substances, and a portion (this portion will be referred to as "II portion"

based on the name of iron oxide (FeO), namely, iron oxide (II)") containing iron oxide (FeO) which is more in quantity than other substances, the III portion the II, III portion, and the II portion being disposed in this order from the outermost surface (slide surface) (coating film configuration 2).

In the coating film configuration 1 and the coating film configuration 2 of the oxide coating film 170, the III portion of the outermost surface contains diiron trioxide ($Fe_2O_3$) as a major component, and the II, III portion containing triiron tetraoxide ($Fe_3O_4$) as a major component is located under the III portion. The crystal structure of triiron tetraoxide ($Fe_3O_4$) is cubical crystals stronger than the crystal structure of diiron trioxide ($Fe_2O_3$). Therefore, the III portion is supported by the II, III portion as the underlayer.

In the coating film configuration 2 of the oxide coating film 170, the II portion containing iron oxide (FeO) as a major component is located under the II, III portion. The iron oxide (FeO) is present as amorphous having no crystal structure, in the interface of the surface of the base material 171. Therefore, the II portion can effectively lessen presence of a weak structure such as a crystal grain boundary or lattice defects. For this reason, while the slide member is sliding, the bearing force of the oxide coating film 170 with respect to a load can be improved. This may contribute to suppressing of the peeling of the oxide coating film 170 and improvement of the adhesivity of the oxide coating film 170 with respect to the base material 171.

As can be clearly seen from the result of the element mapping of silicon (Si) of FIG. 2D, the oxide coating film 170 includes a silicon containing portion containing silicon (Si) which is more in quantity than that of the base material 171. In the coating film configuration 1 and the coating film configuration 2 of the oxide coating film 170, at least the II, III portion contains the silicon (Si) compound in addition to triiron tetraoxide ($Fe_3O_4$) which is more in quantity than other substances. In a case where the II portion is present under the II, III portion, the II, III portion contains the silicon (Si) compound, as well.

As can be clearly seen from the intensity ratio of silicon (Si) of FIG. 2D, in the oxide coating film 170, a portion containing silicon (Si) which is more in quantity, namely, the silicon containing portion is present in a region closer to the base material 171. This silicon containing portion substantially conforms to at least a part of the II, III portion, or the II, III portion and the II portion.

The II, III portion is divided into a portion containing silicon (Si) less in quantity in a region closer to the outermost surface and a portion containing silicon (Si) less in quantity in a region closer to the base material 171. The upper portion containing silicon (Si) less in quantity will be referred to as "II, III portion a", while the lower portion containing silicon (Si) more in quantity will be referred to as "II, III portion b". The interface between the II, III portion a and the II, III portion b matches a location where the intensity ratio of silicon (Si) is significantly reduced in the example of FIG. 2D.

Figure 4:
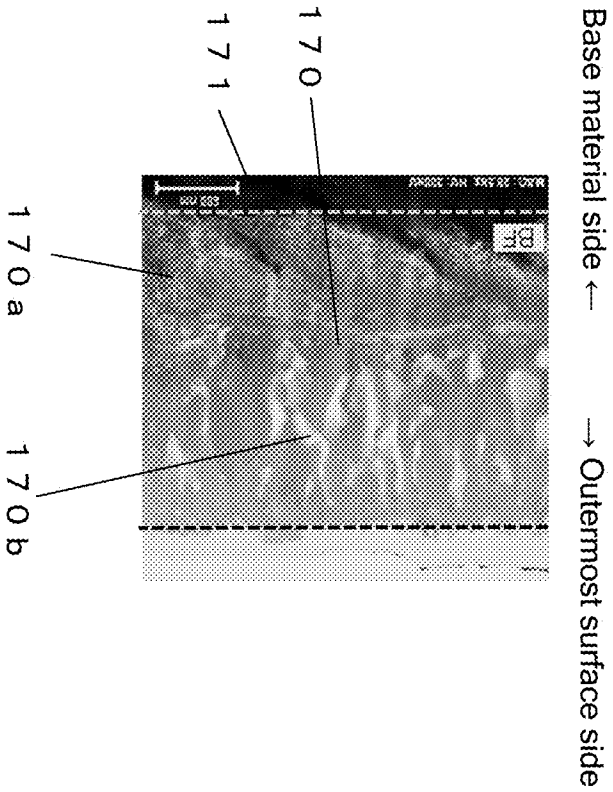
FIG. 4 is a TEM (transmission electron microscope) image showing an example of a result of TEM observation performed for the oxide coating film provided on the slide member of the refrigerant compressor according to Embodiment 1.

FIG. 4 shows a TEM image showing an example of a result of TEM observation performed for another sample of the oxide coating film 170, different from the sample (the oxide coating film 170 formed on the base material 171) shown in FIGS. 2A to 2D.

As shown in FIG. 4, a portion (II, III portion, or II, III portion and II portion) of the oxide coating film 170 which is closer to the base material 171 is the silicon containing portion 170*a* containing silicon (Si) which is more in quantity than that of the base material 171. A portion (at least one of II, III portion and III portion) of the oxide coating film 170 which is closer to the outermost surface than the silicon containing portion 170*a* includes a spot-shaped silicon containing portion 170*b* which is a portion containing silicon (Si) which is more in quantity than that of a surrounding region (region surrounding the spot-shaped silicon containing portion 170*b*). This spot-shaped silicon containing portion 170*b* is observed as a white spot in the TEM observation or the like of FIG. 4, and therefore can also be expressed as "white portion". Increase in the concentration or intensity of silicon (Si) of this white portion is observed.

The content of silicon (Si) of the upper II, III portion a of the II, III portion is lower than that of the lower II, III portion b (silicon containing portion 170*a*) of the II, III portion. The II, III portion a contains the white portion, namely, the spot-shaped silicon containing portion 170*b*. In Embodiment 1, the III portion which is closer to the outermost surface contains almost no silicon (Si). However, by adjusting conditions, the III portion can contain the white portion, namely, the spot-shaped silicon containing portion 170*b*.

The spot-shaped silicon containing portion 170*b* contains silicon (Si) compounds which are different in structure, such as silicon dioxide ($SiO_2$) and/or fayalite ($Fe_2SiO_4$). In some cases, the white portion includes solid-solved silicon (Si) (silicon (Si) is present as elemental substances), instead of the silicon (Si) compound. Therefore, in some cases, the III portion and/or the II, III portion a includes solid-solved silicon (Si) portion as well as the portion containing silicon (Si) compound, as the spot-shaped silicon containing portion 170*b*.

It is sufficient that the oxide coating film 170 includes at least the silicon containing portion 170*a* in a layered form (part of the II, III portion, the II portion, or the like), in a region which is closer to the base material 171. Preferably, it is sufficient that the oxide coating film 170 includes the spot-shaped silicon containing portion 170*b* which is a portion containing silicon (Si) which is more in quantity than that of the surrounding region, in a region that is closer to the outermost surface than the silicon containing portion 170*a*. Specific configurations of the oxide coating film 170 are, as described above, the coating film configuration 1 including the III portion and the II, III portion, or the coating film configuration 2 including the III portion, the II, III portion, and the II portion. The configuration of the oxide coating film 170 is not limited to these.

As a preferable example, as described above, the oxide coating film 170 has a configuration in which the III portion, the II, III portion a and the II, III portion b (and the II portion) which are stacked in this order from the outermost surface. The oxide coating film 170 is not limited to the configuration including 3 or 4 layers. The oxide coating film 170 may include a layer other than these layers, or may not include some of these layers. Some of these layers may be interchangeable.

The configuration including another layer, or the configuration which is different in stacking order of the layers can be easily realized by adjusting conditions. Further, formation of the silicon containing portion 170*a* in a region closer to the base material 171, adjustment of the concentration of silicon (Si) of the silicon containing portion 170*a*, and formation of the spot-shaped silicon containing portion 170*b* can be realized by adjusting conditions.

As typical example of the conditions, there is a manufacturing method (formation method) of the oxide coating film 170. As the manufacturing method of the oxide coating film 170, a known oxidation method of the iron-based material may be suitably used. The manufacturing method of the oxide coating film 170 is not limited. Manufacturing conditions or the like can be suitably set, depending on the conditions which are the kind of the iron-based material which is the base material 171, its surface state (the above-described polishing finish, etc.), desired physical property of the oxide coating film 170, and the like. In the present disclosure, the oxide coating film 170 can be formed on the surface of the base material 171 by oxidating gray cast iron as the base material 171 within a range of several hundreds degrees C., for example, within a range of 400 to 800 degrees C., by use of a known oxidation gas such as a carbon dioxide gas and known oxidation equipment.

In particular, in the present disclosure, to form the silicon containing portion 170*a* in a region of the oxide coating film 170 which is closer to the base material 171, or to form the spot-shaped silicon containing portion 170*b* in a region of the oxide coating film 170 which is closer to the outermost surface, the oxide coating film 170 can be manufactured (formed) by the following methods. For example, a method (1) silicon (Si) is added to the base material 171 and then the base material 171 is oxidated, or a method (2) a compound having an iron diffusion barrier function such as phosphate is formed (or caused to be present) on the surface of the base material 171 at an initial stage of an oxidation reaction, may be used.

[Evaluation of Oxide Coating Film]

Next, regarding a typical example of the oxide coating film 170 according to Embodiment 1, a result of evaluation of the characteristic of the oxide coating film 170 will be described with reference to FIGS. 5 and 6. Hereinafter, the abrasion suppressing effect of the oxide coating film 170, namely, the abrasion resistance of the oxide coating film 170 will be evaluated, based on results of Example, Prior Art Example, and Comparative Example.

Example 1

As the slide member, a disc made of spherical graphite cast iron was used. The base material 171 was spherical graphite cast iron. The surface of the disc was the slide surface. As described above, the disc was oxidated within a range of 400 to 800 degrees C., by use of the oxidation gas such as the carbon dioxide gas, to form the oxide coating film 170 according to Embodiment 1 on the slide surface. As described above, the oxide coating film 170 included the silicon containing portion 170*a* in a region which is closer to the base material 171, and the spot-shaped silicon containing portion 170*b* in a region which is closer to the outermost surface. In this way, evaluation sample of Example 1 was prepared. The abrasion resistance of the evaluation sample and attacking characteristic of the evaluation sample with respect to the other member (sliding between the evaluation sample and the other member occurred) were evaluated as will be described later.

Prior Art Example 1

As a surface treatment film, the conventional phosphate coating film was formed instead of the oxide coating film 170 according to Embodiment 1. Except this, the evaluation sample of Prior Art Example 1 was prepared as in Example 1. The abrasion resistance of the evaluation sample and attacking characteristic of the evaluation sample with respect to the other member (sliding between the evaluation sample and the other member occurred) were evaluated as will be described later.

Comparative Example 1

As a surface treatment film, a gas nitride coating film which is generally used as a hard film was formed instead of the oxide coating film 170 according to Embodiment 1. Except this, the evaluation sample of Comparative Example 1 was prepared as in Example 1. The abrasion resistance of the evaluation sample and attacking characteristic of the evaluation sample with respect to the other member (sliding between the evaluation sample and the other member occurred) were evaluated as will be described later.

Comparative Example 2

As a surface treatment film, a conventional general oxide coating film, namely, triiron tetraoxide ($Fe_3O_4$) single portion coating film was formed by a method called black oxide coating (fellmight treatment), instead of the oxide coating film 170 according to Embodiment 1. Except this, the evaluation sample of Comparative Example 2 was prepared as in Example 1. The abrasion resistance of the evaluation sample and attacking characteristic of the evaluation sample with respect to the other member (sliding between the evaluation sample and the other member occurred) were evaluated as will be described later.

(Evaluation of Abrasion Resistance and Attacking Characteristic with Respect to the Other Member)

The ring on disc abrasion test was conducted on the above-described evaluation samples in a mixture ambience including R134a refrigerant and ester oil with VG3 (viscosity grade at 40 degrees C. was 3 $mm^2/s$). In addition to discs as the evaluation samples, rings each including a base material made of gray cast iron and having a surface (slide surface) having been subjected to the surface polish, were prepared as the other members (sliding between the evaluation sample and the other member occurred). The abrasion test was conducted under a condition of a load 1000N, by use of intermediate (medium) pressure CFC friction/abrasion test machine AFT-18-200M (product name) manufactured by A&D Company, Limited. In this way, the abrasion resistance of the surface treatment film formed on the evaluation sample (disc) and the attacking characteristic of the evaluation sample with respect to the slide surface of the other member (ring) were evaluated.

Comparison Among Example 1, Prior Art Example 1, Comparative Example

Figure 5:
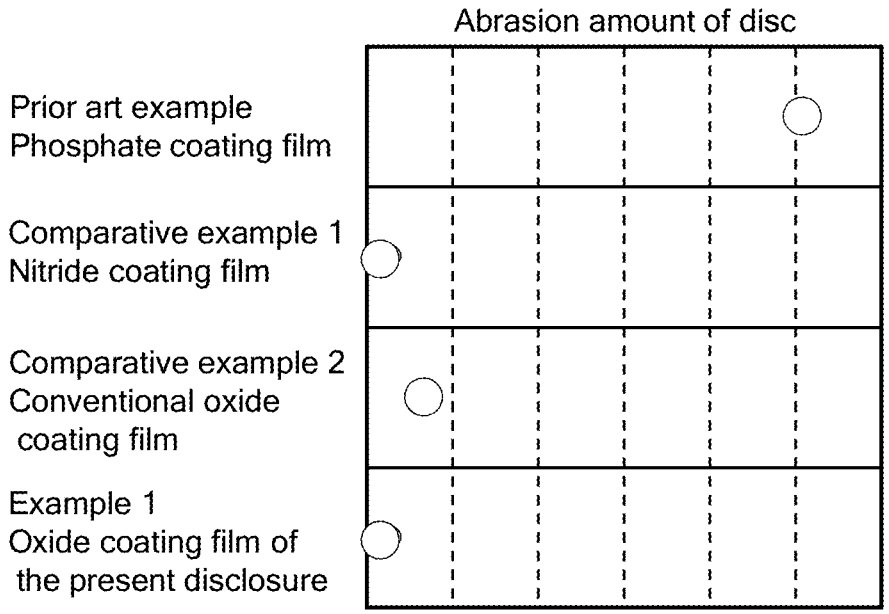
FIG. 5 is a view showing the abrasion amounts of discs in conjunction with the oxide coating film according to Embodiment 1, after a ring on disc abrasion test is conducted.
Figure 6:
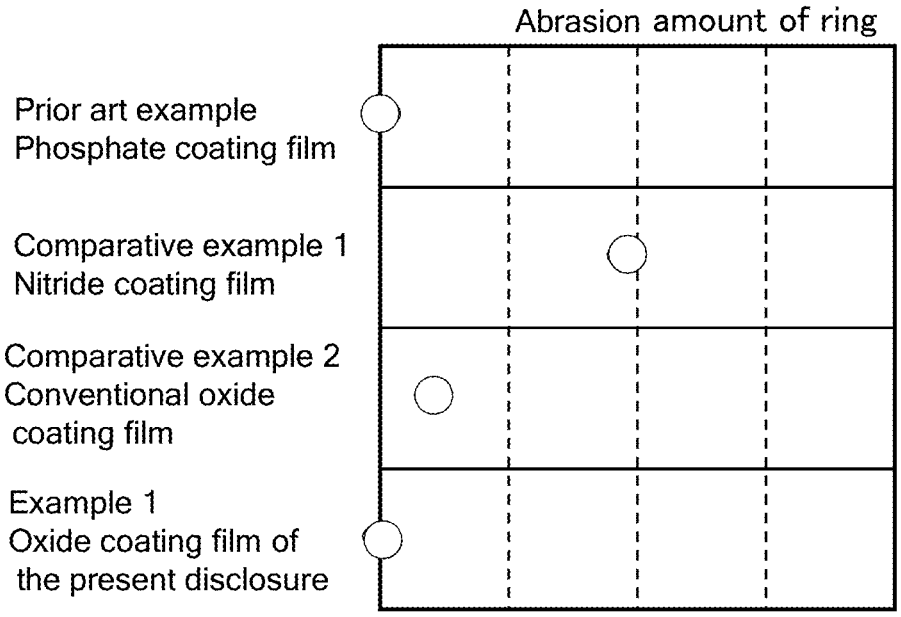
FIG. 6 is a view showing the abrasion amounts of rings in conjunction with the oxide coating film according to Embodiment 1, after the ring on disc abrasion test is conducted.

FIG. 5 shows a result of the ring on disc abrasion test and shows the abrasion amounts of the discs as the evaluation samples. FIG. 6 shows a result of the ring on disc abrasion test and shows the abrasion amounts of the rings as the other members.

Initially, comparison will be made for the abrasion amounts of the surfaces (slide surfaces) of the discs as the evaluation samples. As shown in FIG. 5, the abrasion amounts of the surfaces of the discs were less in the surface treatment films of Example 1, Comparative Example 1, and Comparative Example 2 than in the phosphate coating film of Prior Art Example 1. From this, it was found out that the surface treatment films of Example 1, Comparative Example 1, and Comparative Example 2 had good abrasion resistances. However, it was found out that regarding the surface treatment film (general oxide coating film) of Comparative Example 2, including triiron tetraoxide ($Fe_3O_4$) single portion, several portions of the surface of the disc were peeled from the interface with the base material.

Then, comparison will be made for the abrasion amounts of the surfaces (slide surfaces) of the rings as the other members (sliding between the evaluation sample and the other member occurred) with reference to FIG. 6. The abrasion amount of the surface of the ring corresponding to the surface treatment film of Example 1, namely, the oxide coating film 170 according to Embodiment 1 was almost equal to that of the phosphate coating film of Prior Art Example 1. In contrast, it was observed that the abrasion amounts of the surfaces of the rings corresponding to the gas nitride coating film of Comparative example 1, and the general oxide coating film of Comparative example 2 were more than those of Example 1 and Prior Art Example 1. From these results, it was found out that the attacking characteristic of the oxide coating film 170 according to Embodiment 1 with respect to the other member was less as in the conventional phosphate coating film.

As should be understood from the above, the abrasions of the disc and the ring, corresponding to only Example 1 using the oxide coating film 170 according to the present disclosure were not substantially observed. Thus, the oxide coating film 170 according to the present disclosure exhibited favorable abrasion resistance and attacking characteristic with respect to the other member.

The abrasion resistance of the oxide coating film 170 will be discussed. Since the oxide coating film 170 is the iron oxidation product, the oxide coating film 170 is very chemically stable compared to the conventional phosphate coating film. In addition, the coating film of the iron oxidation product has a hardness higher than that of the phosphate coating film. By forming the oxide coating film 170 on the slide surface, generation, adhesion, or the like of abrasion powder can be effectively prevented. As a result, the increase in the abrasion amount of the oxide coating film 170 can be effectively avoided.

Next, the attacking characteristic of the oxide coating film 170 with respect to the other member will be discussed. The oxide coating film 170 includes the III portion containing diiron trioxide ($Fe_2O_3$) which is more in quantity than other substances, in the region which is closer to the outermost surface. Therefore, the oxide coating film 170 can suppress the attacking characteristic with respect to the other member and improve the conformability of the slide surface, for the reasons stated below.

The crystal structure of diiron trioxide ($Fe_2O_3$) is rhombohedral crystal. The crystal structure of triiron tetraoxide ($Fe_3O_4$) is cubical crystal. The crystal structure of the nitride coating film is hexagonal close-packed crystal, face-centered cubical crystal, and body-centered tetragonal crystal. For this reason, diiron trioxide ($Fe_2O_3$) is flexible (or weak) in the crystal structure compared to triiron tetraoxide ($Fe_3O_4$) or the nitride coating film. Therefore, the III portion has a low hardness in the grain (particle) level.

The oxide coating film 170 including diiron trioxide ($Fe_2O_3$) in the outermost surface has a hardness in grain (particle) level lower than that of the gas nitride coating film of Comparative Example 1 or general oxide coating film (triiron tetraoxide ($Fe_3O_4$) single portion coating film) of Comparative Example 2. Therefore, the oxide coating film 170 of Example 1 can effectively suppress the attacking characteristic with respect to the other member, and improve the conformability of the slide surface, compared to the surface treatment film of Comparative Example 1 or the surface treatment film of Comparative Example 2.

Although in the ring on disc abrasion test of Embodiment 1, the test was conducted in a state in which the disc was provided with the oxide coating film, the same effects can be obtained by providing the oxide coating film on the ring. The evaluation method of the abrasion resistance of the oxide coating film is not limited to the ring on disc abrasion test, and another test method may be used.

Example 2

Next, a device reliability test was conducted on the refrigerant compressor 100 including the crankshaft 108 provided with the oxide coating film 170 according to Embodiment 1. The refrigerant compressor 100 has the configuration of FIG. 1 as described above, which will not be described in repetition. In the device reliability test, as in the above-described Example 1, or the like, R134a refrigerant and ester oil with VG3 (viscosity grade at 40 degrees C. was 3 $mm^2/s$) were used. To accelerate the abrasion of the main shaft section 109 of the crankshaft 108, the refrigerant compressor 100 was operated in a high-temperature high-load intermittent operation mode in which operation (running) and stopping of the refrigerant compressor 100 were repeated within a short time under a high-temperature state.

After the device reliability test was finished, the refrigerant compressor 100 was disassembled, the crankshaft 108 was taken out, and the slide surface of the crankshaft 108 was checked. Based on a result of the observation of the slide surface, evaluation of the device reliability test was conducted.

Prior Art Example 2

The device reliability test was conducted on the refrigerant compressor 100 including the crankshaft 108 as in Example 2, except that the crankshaft 108 was provided with the conventional phosphate coating film. After the device reliability test was finished, the refrigerant compressor 100 was disassembled, the crankshaft 108 was taken out, and the slide surface of the crankshaft 108 was checked.

Comparison Between Example 2 and Prior Art Example 2

In Prior Art Example 2, the abrasion occurred in the slide surface of the crankshaft 108, and damage to the phosphate coating film was observed. In contrast, in Example 2, damage to the slide surface of the crankshaft 108 was very slight. Thus, even though the refrigerant compressor 100 was operated under the harsh condition, the oxide coating film 170 remained in the slide surface of the crankshaft 108. From this, it was found out that the abrasion resistance of the slide member (the crankshaft 108 in Example 2) including the oxide coating film 170 was very high in an environment in which the refrigerant was compressed.

Based on the result of Example 1 and Example 2, consideration will be given to the fact that the oxide coating film 170 is higher in abrasion resistance and peeling strength than the general oxide coating film (triiron tetraoxide ($Fe_3O_4$) single portion coating film) of Comparative Example 2.

As described above, it is estimated that in the oxide coating film 170 according to Embodiment 1, iron-deficiency state is formed in the oxidation reaction and inward diffusion of oxygen is facilitated in the region which is in the vicinity of the interface with the base material 171, at an initial stage of manufacturing (formation of the coating film). Therefore, it is considered that oxidation of iron oxide (FeO) formed at the initial stage of the oxidation reaction is accelerated, and as a result, diiron trioxide ($Fe_2O_3$) as the major component of the III portion, or triiron tetraoxide ($Fe_3O_4$) as the major component of the II, III portion is generated.

These iron oxidation products have crystal structures which contribute to the abrasion resistance. In addition, diiron trioxide ($Fe_2O_3$) is more flexible in crystal structure than triiron tetraoxide ($Fe_3O_4$). In other words, triiron tetraoxide ($Fe_3O_4$) is stronger in crystal structure than diiron trioxide ($Fe_2O_3$). Since the flexible diiron trioxide ($Fe_2O_3$) layer is supported by the strong triiron tetraoxide ($Fe_3O_4$) layer, the oxide coating film 170 can have a high abrasion resistance.

As described above, it is estimated that the amorphous iron oxide (FeO) having no crystal structure is formed in the region of the oxide coating film 170 which is in the vicinity of the interface with the base material 171. The amorphous iron oxide (FeO) layer can effectively lessen the presence of the weak structure such as the crystal grain boundary or the lattice defects. For this reason, the peeling strength of the oxide coating film 170, as well as the abrasion resistance of the oxide coating film 170, can be improved.

Further, the portion (at least a part of the II, III portion, and the II portion) of the oxide coating film 170 which is located closer to the base material 171 is the silicon containing portion 170*a*. Because of the presence of this silicon containing portion 170*a*, the adhesive force (bearing force) of the oxide coating film 170 is improved.

For example, in Kobe Steel, Ltd Technical Report Vol. 1.55 (No. 1 April 2005), it is recited that (1) the oxide coating film (scaling) is generated on the surface of a steel plate in a hot rolling step of an iron/steel material, and (2) descaling characteristic reduces as the amount of silicon contained in the iron/steel material increases. These recitations suggest that an oxide product containing silicon and iron can improve the adhesivity of the oxide coating film onto the surface of the iron-based material.

The oxide coating film 170 of Example 1 has a configuration in which the III portion, the II, III portion a and the II, III portion b (and the II portion depending on the condition) which are stacked in this order from the outermost surface. The II, III portion b (and the II portion in a case where the oxide coating film 170 includes the II portion) is the silicon containing portion 170*a* containing silicon (Si) which is more in quantity than that of the base material 171. Thus, since the content of the silicon (Si) is higher in the region of the oxide coating film 170 which is closer to the base material 171 and higher than that of the base material 171 (see FIG. 2D), the adhesivity (bearing force) of the oxide coating film 170 is higher than that of the conventional oxide coating film formed by oxidating the iron-based material containing silicon.

In the oxide coating film 170 of Example 1, the content of silicon (Si) of each of the II, III portion a and the III portion is lower than that of the II, III portion b. The II, III portion a and the III portion include the spot-shaped silicon containing portion 170*b* which is a portion in which the content of silicon (Si) is high. Because of the presence of the spot-shaped silicon containing portions 170*b*, a number of silicon (Si) compounds which are relatively hard are present in the region of the oxide coating film 170 which is closer to the outermost surface. Therefore, the abrasion resistance of the oxide coating film 170 can be further improved.

Modified Example, Etc

In Embodiment 1, the sealed container 101 reserves therein the lubricating oil 103 with a viscosity of VG2 to VG100, accommodates therein the electric component 106 and the compression component 107 which is driven by the electric component 106 and compresses the refrigerant, and at least one slide member included in the compression component 107 includes the base material 171 made of the iron-based material and the oxide coating film 170 formed on the surface of the base material 171. The oxide coating film 170 includes the portion (III portion) containing diiron trioxide ($Fe_2O_3$) in the region which is closer to the outermost surface, and the silicon containing portion 170*a* containing silicon (Si) which is more in quantity than that of the base material 171, in the region which is closer to the base material 171.

In this structure of the oxide coating film 170, the silicon containing portion 170*a* can improve the adhesivity to the base material 171, and the portion containing diiron trioxide ($Fe_2O_3$) can effectively suppress the attacking characteristic with respect to the other member and improve the conformability of the slide surface. In this structure, the abrasion resistance of the slide member can be further improved. Therefore, the viscosity of the lubricating oil 103 can be reduced, and the slide length of the slide members (a distance for which the slide members slide) constituting the slide sections can be designed to be shorter. Since a sliding loss of the slide section can be reduced in this configuration, reliability, efficiency, and performance of the refrigerant compressor 100 can be improved.

Although the thickness of the oxide coating film 170 is about 3 μm in Embodiment 1, the thickness of the oxide coating film 170 is not limited to this. Typically, the thickness of the oxide coating film 170 may be in a range of 1 to 5 μm. In a case where the thickness of the oxide coating film 170 is less than 1 μm, it is difficult for the oxide coating film 170 to maintain the characteristic such as the abrasion resistance over a long period of time, depending on the condition. On the other hand, in a case where the thickness of the oxide coating film 170 is more than 5 μm, surface roughness of the slide surface becomes excess depending on the conditions. Therefore, in some cases, it is difficult to control accuracy of the slide sections constituted by the plurality of slide members.

Although spherical graphite cast iron (FCD cast iron) is used as the base material 171 in Embodiment 1, the material of the base material 171 is not limited to this. The specific structure of the base material 171 provided with the oxide coating film 170 is not particularly limited so long as it is the iron-based material. Typically, cast iron is suitably used as the base material 171, and the iron-based material is not limited to the cast iron. The base material 171 may be a steel material, a sintered material, or other iron-based materials. Also, the specific kind of the cast iron is not particularly limited, and may be spherical graphite cast iron (FCD cast iron) as described above, gray cast iron (cast iron, FC cast iron), or other cast irons.

Commonly, gray cast iron contains about 2% silicon. The content of silicon of the base material 171 is not particularly limited. In a case where the iron-based material contains silicon, the adhesivity of the oxide coating film 170 can be improved in some cases. In general, the cast iron contains about 1 to 3% silicon. Therefore, for example, spherical graphite cast iron (FCD cast iron) can be used as the base material 171. Commonly, the steel material or the sintered material does not substantially contain silicon, or the content of silicon of the steel material or the sintered material is lower than that of the cast iron. About 0.5 to 10% silicon may be added to the steel material or the sintered material. This makes it possible to obtain advantages similar to those in a case where the cast iron is used as the base material 171.

The state of the surface of the base material 171 on which the oxide coating film 170 is formed, namely, the slide surface, is not particularly limited. Typically, the surface of the base material 171 is the polished surface. However, the surface of the base material 171 may be an unpolished surface or a surface having been subjected to a known surface treatment before the oxidation, depending on the kind of the base material 171, the kind of the slide member, or the like.

Although in Embodiment 1, R134a is used as the refrigerant, the kind of the refrigerant is not limited to this. Although in Embodiment 1, the ester oil is used as the lubricating oil 103, the kind of the lubricating oil 103 is not limited to this. Known refrigerant and lubricating oil may be suitably used as combinations of the refrigerant and the lubricating oil 103.

Suitable combinations of the refrigerant and the lubricating oil 103 are, for example, three examples described below. By using these combinations, high efficiency and reliability of the refrigerant compressor 100 can be achieved as in Embodiment 1.

In an example of combination 1, R134a, another HFC-based refrigerant, or HFC-based mixed refrigerant is used as the refrigerant, and ester oil, alkylbenzene oil, polyvinyl ether, polyalkylene glycol, or mixed oil including any of ester oil, alkylbenzene oil, polyvinyl ether, and polyalkylene glycol may be used as the lubricating oil 103.

In an example of combination 2, natural refrigerant such as R600a, R290, or R744, or mixed refrigerant including any of the natural refrigerants is used as the refrigerant, and one of mineral oil, ester oil, alkylbenzene oil, polyvinyl ether, and polyalkylene glycol, or mixed oil including any of mineral oil, ester oil, alkylbenzene oil, polyvinyl ether, and polyalkylene glycol may be used as the lubricating oil 103.

In an example of combination 3, HFO-based refrigerant such as R1234yf or mixed refrigerant of HFO-based refrigerants is used as the refrigerant, and one of ester oil, alkylbenzene oil, polyvinyl ether, and polyalkylene glycol, or mixed oil including any of ester oil, alkylbenzene oil, polyvinyl ether, and polyalkylene glycol may be used as the lubricating oil 103.

Among the above-described combinations, the combination 2 or 3 can suppress global warming by use of the refrigerant which produces less greenhouse effect. In the combination 3, a group of the lubricating oil 103 may further include mineral oil.

Although in Embodiment 1, the refrigerant compressor 100 is the reciprocating refrigerant compressor as described above, the refrigerant compressor of the present disclosure is not limited to the reciprocating refrigerant compressor, and is applicable to other compressors, such as a rotary refrigerant compressor, a scroll refrigerant compressor, or a vibrational refrigerant compressor. The refrigerant compressor to which the present disclosure is applicable can obtain advantages similar to those of Embodiment 1 so long as it has a known configuration including the slide sections, discharge valves, others.

Although in Embodiment 1, the refrigerant compressor 100 is driven by the power supply utility, the refrigerant compressor according to the present disclosure is not limited to this, and may be inverter-driven at any one of a plurality of operating frequencies. By forming the oxide coating film 170 having the above-described configuration on the slide surface of the slide section included in the refrigerant compressor which is inverter-driven at any one of a plurality of operating frequencies, the adhesivity to the base material 171 can be improved, and the conformability of the slide surface, and the like can be improved. Therefore, the abrasion resistance of the slide member can be further improved. This makes it possible to improve reliability of the refrigerant compressor even during a low-speed operation (running) in which the oil is not sufficiently fed to the slide sections, or during a high-speed operation (running) in which the rotational speed of the electric component increases.

Embodiment 2

In Embodiment 2, an example of a refrigeration (freezing) device including any one of the refrigerant compressor of Embodiment 1 will be specifically described with reference to FIG. 7.

Figure 7:
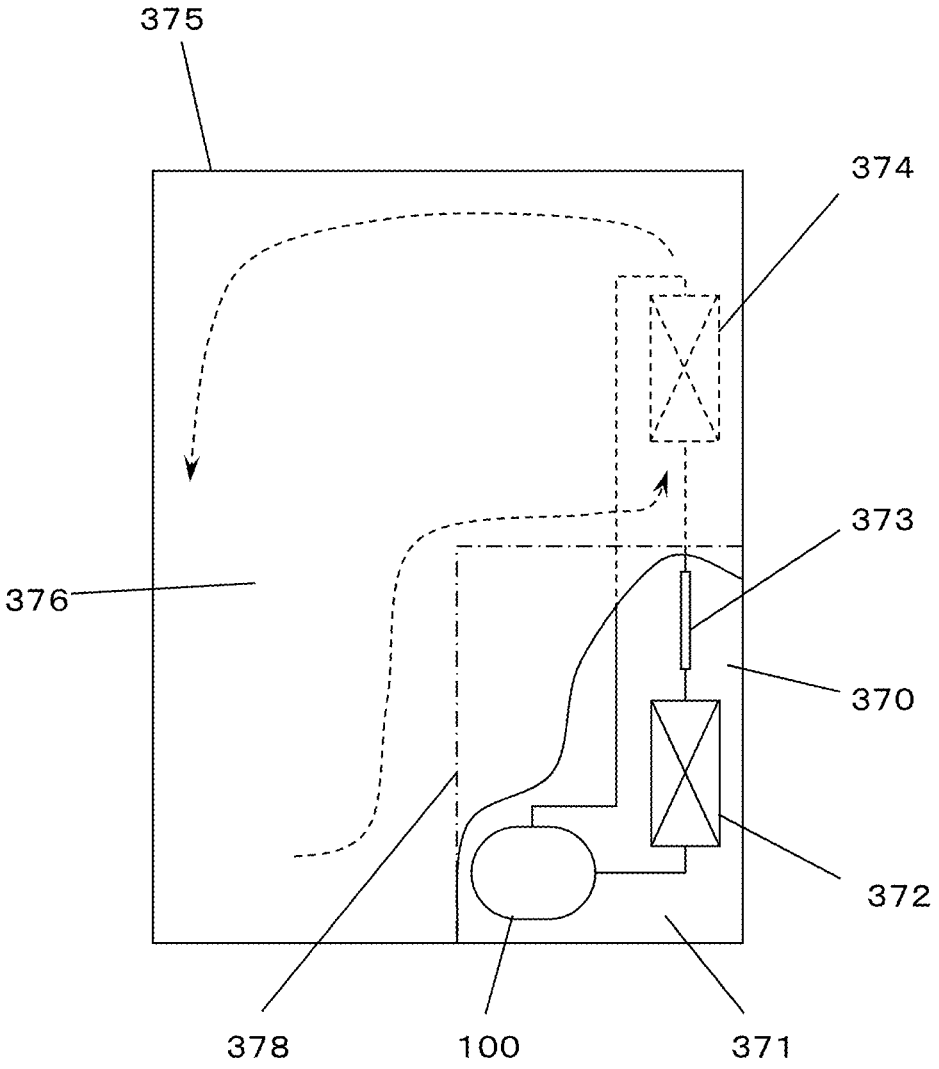
FIG. 7 is a schematic view of a refrigeration device according to Embodiment 2 of the present disclosure.
Figure 8:
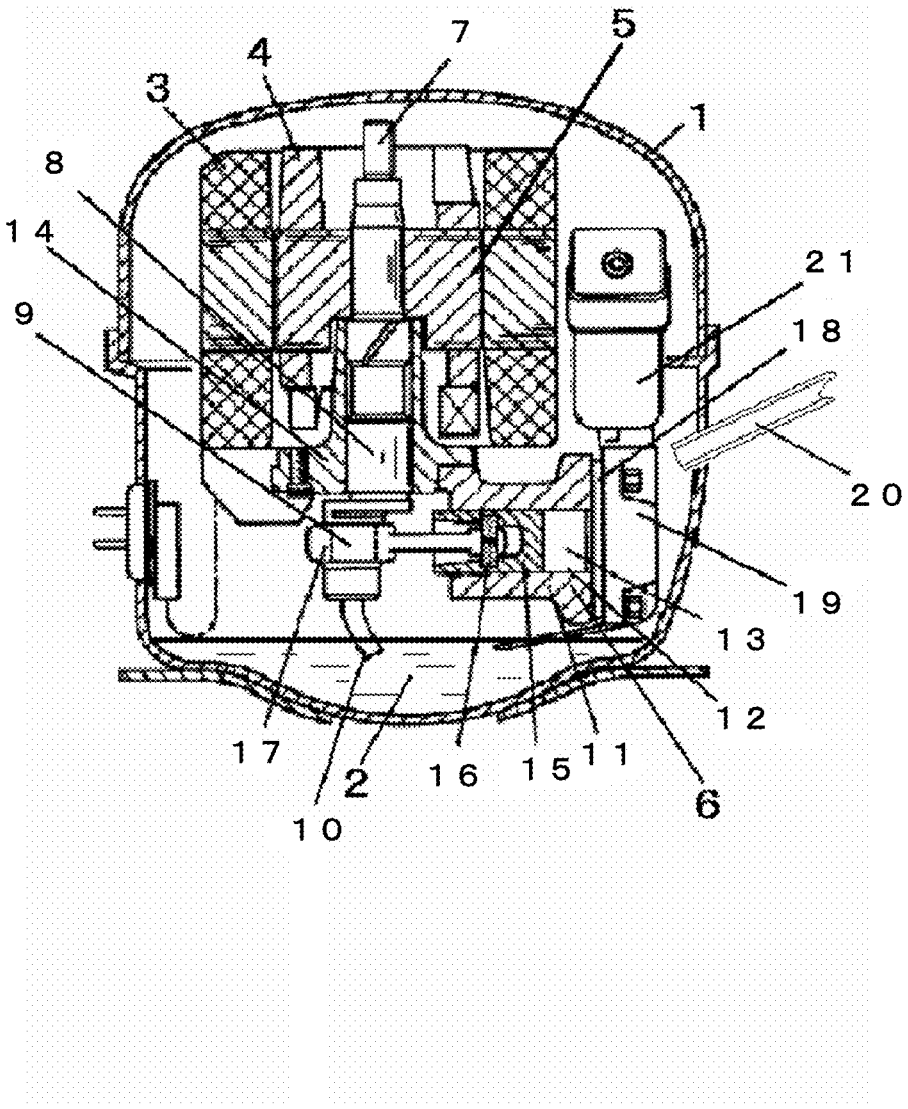
FIG. 8 is a schematic cross-sectional view of a conventional refrigerant compressor.

FIG. 7 is a schematic view of a refrigeration device including the refrigerant compressor 100 according to Embodiment 1. In Embodiment 3, only the schematic basic configuration of the refrigeration device will be described.

As shown in FIG. 7, the refrigeration device according to Embodiment 3 includes a body 375, a partition wall 378, a refrigerant circuit 370, and the like. The body 375 is formed by, for example, a heat insulating casing and doors. A surface of the casing opens and the doors are provided to open and close the opening of the casing. The inside of the body 375 is divided by the partition wall 378 into an article storage space 376 and a mechanical room 377. Inside the storage space 376, a blower (not shown) is provided. Alternatively, the inside of the body 375 may be divided into spaces other than the storage space 376 and the mechanical room 377.

The refrigerant circuit 370 is configured to cool the inside of the storage space 376. The refrigerant circuit 370 includes, for example, the refrigerant compressor 100 of Embodiment 1, a heat radiator 372, a pressure reducing unit 373, and a heat absorber 374 which are annularly coupled to each other by pipes. The heat absorber 374 is disposed in the storage space 376. Cooling heat of the heat absorber 374 is agitated by the blower (not shown) and circulated through the inside of the storage space 376 as indicated by broken-line arrows shown in FIG. 7. In this way, the inside of the storage space 376 is cooled.

The refrigerant compressor 100 included in the refrigerant circuit 370 includes the slide member made of the iron-based material, and the oxide coating film 170 is formed on the slide surface of this slide member, as described in Embodiment 1.

As described above, the refrigeration device according to Embodiment 3 includes the refrigerant compressor 100 according to Embodiment 1. The slide sections included in the refrigerant compressor 100 can improve adhesivity of the oxide coating film 170 to the base material 171 and conformability of the slide surface, or the like. Therefore, the abrasion resistance of the slide member can be further improved. The refrigerant compressor 100 can reduce a sliding loss of the slide sections, and achieve high reliability and high efficiency. As a result, the refrigeration device according to Embodiment 3 can reduce electric power consumption, realize energy saving.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

As described above, the present invention can provide a refrigerant compressor which can obtain high reliability under a condition in which it uses lubricating oil with a low viscosity, and a refrigeration device using this refrigerant compressor. Therefore, the present invention is widely applicable to devices using refrigeration cycles.

REFERENCE SIGNS LIST

100 refrigerant compressor
101 sealed container
103 lubricating oil
106 electric component
107 compression component
108 crankshaft (slide member)
170 oxide coating film
170*a* silicon containing portion
170*b* spot-shaped silicon containing portion
171 base material
200 refrigerant compressor
201 sealed container
207 compression component
208 crankshaft (slide member)
370 refrigerant circuit
372 heat radiator
373 pressure reducing unit
374 heat absorber

The invention claimed is:

1. A refrigerant compressor which
reserves lubricating oil with a viscosity of VG2 to VG100 in a sealed container, and
accommodates therein an electric component and a compression component which is driven by the electric component and compresses a refrigerant,
the compression component including at least one slide member comprising a base material made of an iron-based material and an oxide coating film provided on a surface of the base material, and
the oxide coating film including:
a portion containing diiron trioxide ($Fe_2O_3$), in a region which is closer to an outermost surface of the oxide coating film; and
a silicon containing portion containing silicon (Si) which is more in quantity than silicon (Si) of the base material, in a region which is closer to the base material,
wherein the oxide coating film includes a spot-shaped silicon containing portion that is located closer to the outermost surface of the oxide coating film than the silicon containing portion, the spot-shaped silicon containing portion being a portion containing silicon (Si) which is more in quantity than silicon (Si) contained in a region surrounding the spot-shaped silicon containing portion.

2. The refrigerant compressor according to claim 1,
wherein the oxide coating film includes at least:
a portion containing diiron trioxide ($Fe_2O_3$) which is more in quantity than other substances; and
a portion containing triiron tetraoxide ($Fe_3O_4$) which is more in quantity than other substances, the portion containing diiron trioxide ($Fe_2O_3$) and the portion containing triiron tetraoxide ($Fe_3O_4$) being arranged in this order from the outermost surface.

3. The refrigerant compressor according to claim 1,
wherein the oxide coating film includes at least:
a portion containing diiron trioxide ($Fe_2O_3$) which is more in quantity than other substances;
a portion containing triiron tetraoxide ($Fe_3O_4$) which is more in quantity than other substances; and
a portion containing iron oxide (FeO) which is more in quantity than other substances, the portion containing diiron trioxide ($Fe_2O_3$), the portion containing triiron tetraoxide ($Fe_3O_4$), and the portion containing iron oxide (FeO) being arranged in this order from the outermost surface.

4. The refrigerant compressor according to claim 1,
wherein the oxide coating film has a thickness in a range of 1 to 5 μm.

5. The refrigerant compressor according to claim 1,
wherein the base material contains 0.5 to 10% silicon.

6. The refrigerant compressor according to claim 1,
wherein the iron-based material which is the base material is cast iron.

7. The refrigerant compressor according to claim 1,
wherein the refrigerant is a HFC-based refrigerant, or a mixed refrigerant of the HFC-based refrigerant, and the lubricating oil is one of ester oil, alkylbenzene oil, polyvinyl ether, and polyalkylene glycol, or mixed oil including any of ester oil, alkylbenzene oil, polyvinyl ether, and polyalkylene glycol.

8. The refrigerant compressor according to claim 1,
wherein the refrigerant is a natural refrigerant, or a mixed refrigerant including any of the natural refrigerants, and the lubricating oil is one of mineral oil, ester oil, alkylbenzene oil, polyvinyl ether, and polyalkylene glycol, or mixed oil including any of mineral oil, ester oil, alkylbenzene oil, polyvinyl ether, and polyalkylene glycol.

9. The refrigerant compressor according to claim 1,
wherein the refrigerant is a HFO-based refrigerant, or a mixed refrigerant of the HFO-based refrigerant, and the lubricating oil is one of ester oil, alkylbenzene oil, polyvinyl ether, and polyalkylene glycol, or mixed oil including any of ester oil, alkylbenzene oil, polyvinyl ether, and polyalkylene glycol.

10. The refrigerant compressor according to claim 1,
wherein the electric component is inverter-driven at one of a plurality of operating frequencies.

11. A refrigeration device comprising:
a refrigerant circuit including the refrigerant compressor according to claim 1, a heat radiator, a pressure reducing unit, and a heat absorber, which are annularly coupled to each other via a pipe.

12. The refrigerant compressor according to claim 7, wherein the HFC-based refrigerant is R134a.

13. The refrigerant compressor according to claim 8, wherein the natural refrigerant is at least one selected from the group consisting of R600a, R290, and R744.

14. The refrigerant compressor according to claim 9, wherein the HFO-based refrigerant is R1234yf.

* * * * *